United States Patent [19]

Desplats et al.

[11] 4,084,788

[45] Apr. 18, 1978

[54] CLUTCH CONTROL DEVICE FOR CABLE TRACTION APPARATUS

[75] Inventors: André Desplats, Boulogne-Billancourt; Michel Cavalieri, Neuilly sur Marne, both of France

[73] Assignee: Tractel S.A., Bagnolet, France

[21] Appl. No.: 791,103

[22] Filed: Apr. 26, 1977

[30] Foreign Application Priority Data

Apr. 29, 1976 France ..... 76 12740

[51] Int. Cl.[2] ..... B66F 3/00

[52] U.S. Cl. ..... 254/76

[58] Field of Search ..... 254/76, 106–107

[56] References Cited

U.S. PATENT DOCUMENTS

| | | | |
|---|---|---|---|
| 3,863,893 | 2/1975 | Cavalieri | 254/76 |
| 3,981,483 | 9/1976 | Rinio | 254/76 |
| 3,995,830 | 12/1976 | Desplats | 254/76 |

*Primary Examiner*—Robert C. Watson

*Attorney, Agent, or Firm*—William Anthony Drucker

[57] ABSTRACT

The clutch device, adapted to be associated with a traction apparatus provided with a release device comprising two rocking levers, comprises a clutch engaging member associated with one of the rocking levers in order to modify the normal movement of this rocking lever and a clutch control member associated with the other rocking lever and adapted, when actuated, to provide a simultaneous opening of the two clamps of the apparatus.

7 Claims, 4 Drawing Figures

CLUTCH CONTROL DEVICE FOR CABLE TRACTION APPARATUS

BACKGROUND OF THE INVENTION

1. Field of the Invention

The invention relates to metal cable traction apparatus in which a pair of self-tightening clamps connected to a crank-shaft act on the cable according to a reciprocating movement.

2. Description of the Prior Art

Such apparatus are already known, notably according to U.S. Pat. No. 2,585,101 which comprise two kinematic connections each actuated by a separate lever, the one performing the hauling movement and the other performing the release movement.

According to U.S. Pat. No. 3,995,830 the release kinematic connection comprises a pair of rocking levers pivoted respectively at one end to control links of one clamp and interconnected at their other ends through a rod, one of the rocking levers called the release control rocking lever being actuated for a translation movement under the action of the release control lever while the other rocking lever is actuated according to a rotation movement under the effect of the reaction exerted in its middle portion by a link pivoted to a fixed point.

SUMMARY OF THE INVENTION

The present invention has for its object to realize a clutch device allowing the simultaneous opening of the two clamps by modifying the normal movement of at least one of the two rocking levers of the release system.

To this end, the clutch device according to the invention comprises a clutch engaging member associated to one rocking lever of the pair of release rocking levers and, when worked up, adapted to cause a modification of the normal movement of this rocking lever, and a clutch control member associated with the other release rocking lever, the actuation of this clutch rocking lever, simultaneously to the working up of the clutch engaging member, ensuring a rotation of said other release rocking lever for actuating the control links of the pair of clamps in the unclamping direction.

According to a form of embodiment of the clutch device, the clutch engaging member prevents the movement of the middle portion of the release control rocking lever, which is normally submitted to a translation movement, so that the rotation actuation of the other rocking lever in the direction operating in the unclamping direction the control links of the clamp associated therewith causes, due to the connection between the pair of rocking levers, a rotation in the same direction about its securing point of the rocking lever normally submitted to a rotation movement and consequently the opening of the clamp associated with this rocking lever. Advantageously the locking of the middle portion of the release control rocking lever is obtained by locking the release control lever rigidly connected thereto, the locking of the release control lever being obtained by engaging a projecting part of the release control lever with a notch of a pivoted locking lever acting as a stop for the release control lever. According to a complementary characteristic of the invention the actuation of the rocking lever to its abutment position for the release control lever and the keeping thereof in this position are obtained by engaging said locking lever by an extension of the anchoring member of the apparatus when a pull is applied to this anchoring member which is slidably mounted in an aperture of the apparatus casing. It will be understood that such a mounting ensures a supplementary safety by preventing the actuation of the clutch engaging member as long as the apparatus is submitted to a load.

According to another form of embodiment of the apparatus according to the invention, the clutch engaging member ensures complete locking of the rocking lever being normally submitted to a translation movement and consequently a corresponding locking of the control links of the clamp associated therewith pivoted to this rocking lever, while the actuation of the clutch control lever (which can advantageously consist in the release control lever) causes the other rocking lever or release control rocking lever, which is normally submitted to a rotation movement, to rotate about its connection point to the first rocking lever and to actuate in the unclamping direction the control links of the clamp associated therewith and then, by causing this clamp to recede towards the other clamp, to actuate in the unclamping direction the control links of this other clamp through the members of the hauling kinematic connection. In this form of embodiment the clutch engaging member can consist in a locking bent lever adapted, by pivoting, to engage a notch of a rod connecting one end of the rocking lever normally submitted to a rotation movement to the control links of the clamp associated therewith. Advantageously the locking bent lever, in order to cooperate with the rod notch, may be engaged by an extension of the slidingly mounted anchoring member of the apparatus when a pull is applied to this anchoring member.

DESCRIPTION OF THE PREFERRED EMBODIMENTS

Figure 1:
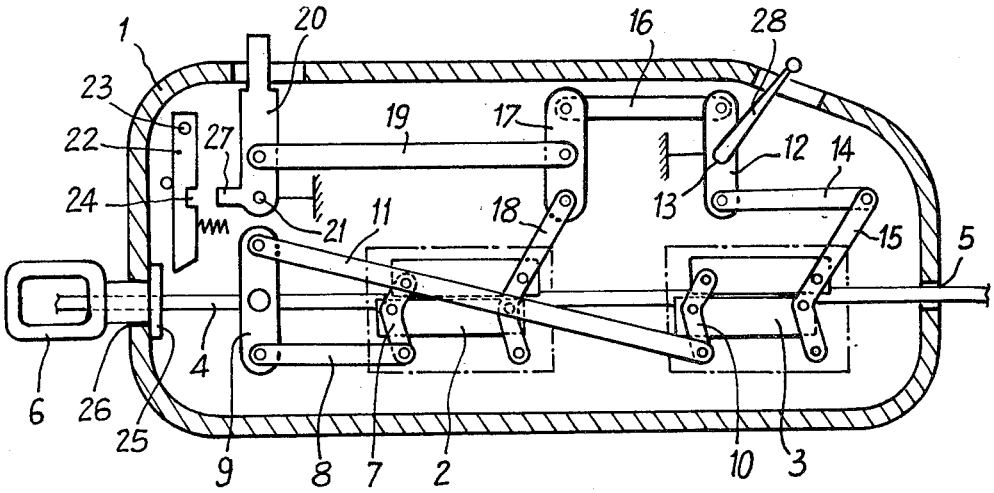
FIG. 1 is a part sectional vertical view of a traction apparatus provided with a release system comprising a pair of rocking levers and equipped with a clutch device according to a first form of embodiment, the clutch device being shown in an inoperative position.
Figure 2:
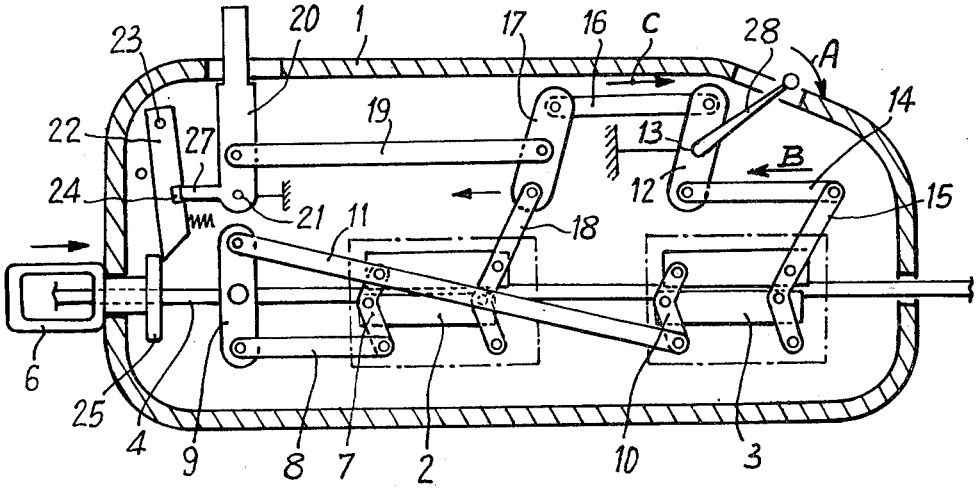
FIG. 2 is a view corresponding to FIG. 1 but showing the clutch device in its operative position.

Referring first to FIGS. 1 and 2 is shown a traction apparatus with a release system comprising a pair of rocking levers, of the general type described in the above mentioned U.S. Pat. No. 3,995,830. This apparatus comprises, with a casing 1, a pair of tandem clamps 2, 3 through which passes a cable 4. Cable 4 projects from the casing 1 at one end through an aperture 5 thereof and, at the opposite end, through an aperture provided in the anchoring member 6 of the apparatus. The control links 7 of clamp 2 are pivoted through a lever 8 to one end of a crank-pin 9 and the control links 10 of the other clamp 3 are pivoted, through a lever 11, to the other end of crank-pin 9. To the crank-pin 9 is associated a hauling control lever not shown in the drawing.

In this embodiment the first rocking lever is 12, and the second rocking lever is 17.

The release control system comprises a rocking lever 12 the middle portion of which is rigid with a transverse shaft 13 rotating in bearings (not shown) provided in the casing. One end of rocking lever 12 is connected through a rod 14 to the ends of the control links 15 of clamp 3 and the opposite end of rocking lever 12 is connected through an arm 16 to one end of another rocking lever 17, called release control rocking lever, of which the other end is pivoted to the ends of the control links 18 of clamp 2. At its middle portion the rocking lever 17 is connected, through a rod 19, to a release control lever 20 rigidly mounted on a transverse shaft 21 rotating in bearings (not shown) provided in casing 1.

The clutch device comprises a clutch engaging member consisting of a lever 22 rotating about a fixed transverse shaft 23 and presenting a notch 24 adapted to engage a projection 27 of the release control lever 20 when lever 22 is pivoted in the anti-clockwise direction after engagement by an extension 25 of the anchoring member 6, when a thrust is applied to this anchoring member which is slidably mounted in an aperture 26 of the casing. As shown in FIG. 2 the engagement of projection 27 of lever 20 by the notch 24 prevents any rotational movement of the release control lever 20 in the clockwise direction and consequently, prevents any translation movement of rocking lever 17 towards the left of FIG. 2. Under these conditions the actuation in the clockwise direction (direction of arrow A of FIG. 2) of the clutch control lever 28 mounted on shaft 13 causes the rotation of rocking lever 12 in the same direction and, by a traction in the direction of the arrow B of FIG. 2 exerted on the rod 14, causes a pivotal movement of the control links 15 in a direction ensuring the unclamping of clamp 3. At the same time the rotation of rocking lever 12 involves, through arm 16, the applying to the upper end of a rocking lever 17 of a traction effort exerted in the direction of arrow C. Due to the locking of its middle portion the rocking lever 17 then describes a rotation movement in the clockwiee direction about this middle portion for actuating in the unclamping direction the control links 18 of clamp 2.

It can be understood that by locking the middle portion of rocking lever 17, which is normally adapted to perform a translation movement, a rotation in the same direction of the two rocking levers 12–17 and consequently a simultaneous opening of the pair of clamps 2–3 can be obtained when actuating the clutch control lever 28.

In the form of embodiment shown at FIGS. 1 and 2 the actuation of lever 22 is obtained by exerting a thrust on the anchoring member 6 but it will be understood that any convenient means for actuating and keeping in position the lever 22 could be utilized. It will be noted however that, concerning the working safety, the actuation of the clutch engaging member by means of a thrust exerted on the anchoring member is particularly advantageous since such a thrust may be exerted only if no load is applied to the apparatus, any riks of an accidental clutch of the apparatus when submitted to a load being thus excluded.

Figure 3:
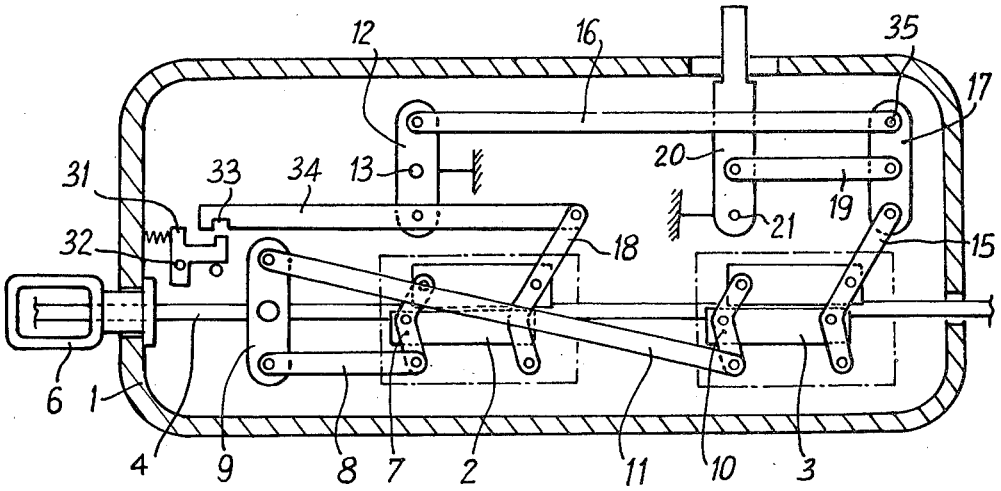
FIG. 3 is a part sectionnal vertical view of a traction apparatus as shown in FIGS. 1 and 2 but with a second form of embodiment of the clutch device, said clutch device being in inoperative position, and FIG. 4 in a view corresponding to FIG. 3 but showing the clutch device in its operative position.
Figure 4:
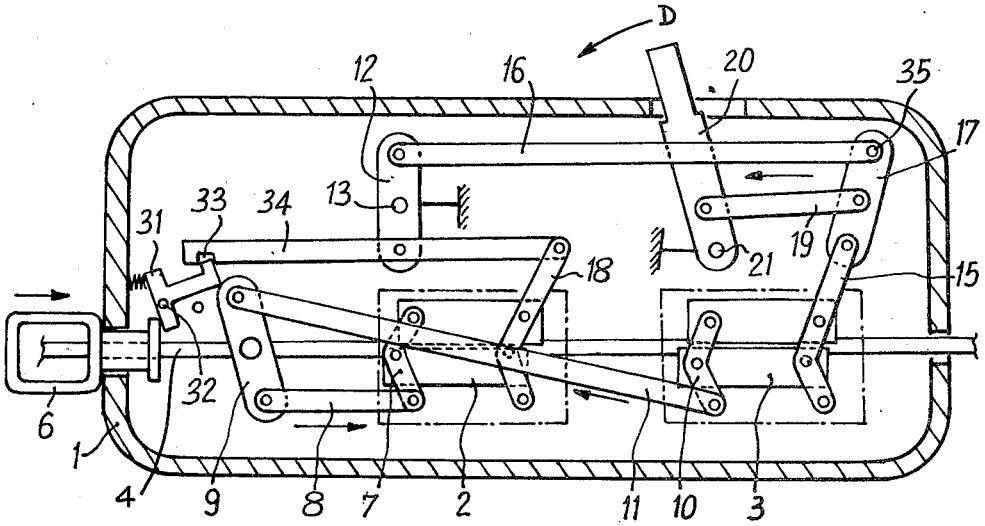

At FIGS. 3 and 4 is shown a second form of embodiment of the clutch device according to the invention and, in these Figures, the same reference numerals designate the members corresponding to those shown at FIGS. 1 and 2. It will be noted that, compared with the device shown at FIGS. 1 and 2, the positions of rocking members 12 and 17 have been inverted, the rocking member 12 (normally rotating about shaft 13) being associated with clamp 2 and the rocking member 17 (normally performing a translation movement) being associated with clamp 3.

In this embodiment, the first rocking lever is 17 and the second rocking lever is 12.

The clutch engaging member consists of a locking bent lever 31, pivotally mounted about a fixed pin 32, said lever 31 being engaged by an extension of the anchoring member 6 (when a thrust towards the right of FIGS. 3 and 4 is applied to this anchoring member) to engage a notch 33 provided at the end of the rod 34 connecting the control links 18 of clamp 2 with the lower end of rocking level 12. When the end of lever 31 engages notch 33, as shown in FIG. 4, any movement of rod 34 towards the left of the Figure is prevented and consequently any rotation in the clockwise direction of rocking lever 12 is made impossible, that prevents any actuation in the clamping direction of the control links 18 of clamp 2.

It will be understood that, under these conditions, a rotational movement in the anti-clockwise direction (direction of arrow D of FIG. 4) applied to the release control lever 20 (acting then as a clutch control lever) causes a rotation in the clockwise direction of rocking lever 17 about its connecting point 35 to the arm 16 since preventing the rotation of rocking lever 12 causes a locking of the connecting point 35 preventing the translation thereof. This rotational movement of rocking lever 17 causes the unclamping of clamp 3 and then, when this clamp is unclamped, a recession movement of clamp 3 towards clamp 2 while producing a rotation in the anit-clockwise direction of the hauling crank-pin 9, under the action of lever 11, this rotation of crank-pin 9 causing through lever 8 the actuation in the unclamping direction of the control links 7 of clamp 2.

It can be seen that by locking the rocking lever 12 and by actuating the rocking lever 17 by means of the release control lever 20, the desired simultaneous unclamping of the pair of clamps may be obtained.

As already remarked for the device of FIGS. 1 and 2, the clutch device of FIGS 3 and 4 foresees an actuation of the locking bent lever 31 under the action of a thrust exerted on the anchoring member 6. It will be understood that this particularly advantageous realisation does not limit the scope of the invention and that any convenient actuating means may be utilized for the locking lever 31.

What we claim is:

1. In a traction apparatus of the kind comprising:

(a) a casing (b) a pair of movable tandem clamps in said casing adapted to perform a reciprocating movement, said clamps having control links (c) a release control device having a pair of rocking levers, a first rocking lever of said pair being adapted to perform a rotary motion, the second rocking lever of said pair being adapted to perform a translatory motion, the improvement which comprises a clutch control device having:

(i) clutch engaging means associated with said first rocking lever and adapted to assume an operative position modifying the movement of said first rocking lever (ii) clutch control means associated with said second rocking lever, said clutch control means when actuated simultaneously with the setting of said clutch engaging means in its operative position causing rotation of said second rocking lever and actuation in unclamping direction of said control links of the pair of clamps.

2. In a traction apparatus of the kind comprising:

(a) a casing (b) a pair of movable tandem clamps in said casing adapted to perform a reciprocating movement, said clamps having control links, (c) a release control device having a pair of rocking levers a first rocking lever of the pair of rocking levers being adapted to perform a translatory motion, the second rocking lever of said pair being adapted to perform a rotary motion, the improvement which comprises a clutch control device having:

(i) clutch engaging means associated with said first rocking lever and adapted when in an operative position to lock a central portion of said first rocking lever for changing the translatory motion thereof into a rotary motion, (ii) clutch control means associated with said second rocking lever and adapted to apply a rotary motion to said second rocking lever, actuation of said clutch control means, when said clutch engaging means is in its operative position, causing rotation of said first and second rocking levers in the same direction and simultaneous unclamping of both clamps.

3. Traction apparatus, as claimed in claim 2 wherein said clutch engaging means comprises a pivoting locking lever adapted, when pivoted to an operative position, to act as a stop for a release control lever connected by an arm to said middle portion said first rocking lever.

4. Traction apparatus, as claimed in claim 3 further comprising an anchoring member slidably mounted in an opening of said casing, said anchoring member, when subjected to thrust, engaging said pivoted locking lever to move said pivoted locking lever into its operative position and to maintain it in its operative position.

5. In a traction apparatus of the kind comprising:

(a) a casing (b) a pair of movable tandem clamps in said casing adapted to perform a reciprocating movement, said clamps having control links, (c) a release control device having a pair of rocking levers, a first rocking lever of said pair being adapted to perform a rotary motion, the second rocking lever of said pair being adapted to perform a translatory motion, the improvement which comprises a clutch control device having:

(i) a clutch engaging means associated with said first locking lever and adapted, when in an operative position, to immobilize said first rocking lever, (ii) a clutch control means associated with said second rocking lever, and including a clutch control lever, (iii) an arm connecting said first rocking lever and said second rocking lever, rotation of said clutch control lever, in a direction to cause clutching, causing rotation of said second rocking lever, about a point of connection thereof to said arm, to (A) unclamp the clamp associated with the second rocking lever, (B) move said unclamped clamp toward the other clamp of the pair, and (C) unclamp said other clamp.

6. Traction apparatus, as claimed in claim 5, wherein said clutch engaging means comprises, for immobilizing said first rocking lever, a pivoting holding lever adapted, when pivoted into an operative position, to engage an extension of a rod connecting said control links of one said clamp of the pair to said first rocking lever.

7. Traction apparatus, as claimed in claim 6, further comprising an anchoring member slidably mounted in an opening of said casing, said anchoring member, when subjected to thrust, engaging said pivoting holding lever to move said holding lever into its operative position and to maintain it in its operative position.

* * * * *